US008820668B2

(12) United States Patent
Hagedorn et al.

(10) Patent No.: US 8,820,668 B2
(45) **Date of Patent: *Sep. 2, 2014**

(54) ROLLER PRESS, PARTICULARLY FOR INTERPARTICLE COMMINUTION

(75) Inventors: Alexander Hagedorn, Pulheim (DE); Christian Splinter, Pulheim (DE); Meinhard Frangenberg, Kürten-Engeldorf (DE); Matthias Mersmann, Lichtenbusch (BE)

(73) Assignee: KHD Humboldt Wedag GmbH, Cologne (DE)

( * ) Notice: Subject to any disclaimer, the term of this patent is extended or adjusted under 35 U.S.C. 154(b) by 232 days.

This patent is subject to a terminal disclaimer.

(21) Appl. No.: 13/305,016

(22) Filed: Nov. 28, 2011

(65) Prior Publication Data

US 2012/0067989 A1 Mar. 22, 2012

Related U.S. Application Data

(63) Continuation of application No. 12/373,364, filed as application No. PCT/EP2007/006259 on Jul. 13, 2007, now abandoned.

(30) Foreign Application Priority Data

Jul. 13, 2006 (DE) ..... 10 2006 032 362

(51) Int. Cl.
*B02C 4/32* (2006.01)

(52) U.S. Cl.
USPC ..... 241/231; 241/285.2

(58) Field of Classification Search
USPC ..... 241/230–232, 234–235, 237, 285.3, 241/285.2
See application file for complete search history.

(56) References Cited

U.S. PATENT DOCUMENTS

| | | | | |
|---|---|---|---|---|
| 2,977,631 | A | | 4/1961 | Komarek et al. |
| 3,899,965 | A | | 8/1975 | Koch et al. |
| 4,709,864 | A | | 12/1987 | Henne et al. |
| 4,938,426 | A | * | 7/1990 | Koenig ..... 241/222 |
| 5,060,874 | A | * | 10/1991 | Sidney et al. ..... 241/231 |
| 5,427,321 | A | | 6/1995 | Takahashi et al. |
| 5,522,557 | A | * | 6/1996 | Tiggesbaumker et al. ..... 241/37 |
| 5,935,496 | A | | 8/1999 | Waatti |
| 5,967,435 | A | * | 10/1999 | Lanham ..... 241/227 |

(Continued)

FOREIGN PATENT DOCUMENTS

| | | |
|---|---|---|
| GB | 783676 | 9/1957 |
| GB | 935363 | 8/1963 |
| WO | WO 2005070549 | 8/2005 |

*Primary Examiner* — Faye Francis
(74) *Attorney, Agent, or Firm* — Greer, Burns & Crain Ltd.

(57) ABSTRACT

In order to create a roller press, particularly for comminuting a bed of material, the roller press having two rollers separated from each other by a roller nip and using hydraulic cylinders to press the one roller against the oppositely situated roller over the material situated in the roller nip, the stress on the surface of the rollers to be reduced and their service life to be increased, it is proposed according to the invention that both rollers are designed as loose rollers that are displaceable transversely relative to the roller nip, the bearing housings of the rollers being supported on side parts of the machine frame by hydraulic cylinders that apply the roller compaction pressure.

5 Claims, 1 Drawing Sheet

(56) References Cited

U.S. PATENT DOCUMENTS

| | | | | |
|---|---|---|---|---|
| 7,198,741 | B2 | 4/2007 | Guzmann et al. | |
| 7,451,945 | B2 | 11/2008 | Wollenhaupt et al. | |
| 7,628,347 | B2 * | 12/2009 | Frangenberg et al. | 241/231 |
| 7,699,254 | B2 * | 4/2010 | Frangenberg et al. | 241/231 |
| 7,841,273 | B2 * | 11/2010 | Splinter et al. | 100/168 |
| 2007/0187538 | A1 | 8/2007 | Wollenhaupt et al. | |

* cited by examiner

ROLLER PRESS, PARTICULARLY FOR INTERPARTICLE COMMINUTION

This application is a Continuation application of U.S. application Ser. No. 12/373,364, now abandoned, a nationalized application having an International filing date of Jul. 13, 2007 and a date of completion of all 35 U.S.C. 371 requirements of Nov. 11, 2009.

BACKGROUND OF THE INVENTION

The invention relates to a roller press for the pressure treatment of granulated material, particularly for the comminuting, compacting or briquetting of a bed of granular material, said press having two rollers, which are rotatably mounted in bearing housings, driven in a contrarotating manner and are separated from each other by a roller nip, the bottom sides and top sides of the bearing housings being mounted on sliding tracks of brackets of the machine frame, using hydraulic cylinders to press the one roller against the oppositely situated roller over the material situated in the roller nip.

In roller grinding to carry out the so-called material bed comminution, the individual pieces or particles of the material to be ground, drawn into the roller nip through friction, such as, for example, raw cement material, cement clinker, ore or the like, are pressed and mutually comminuted at a high pressure in a material bed, that is to say in a material fill compacted between the surfaces of the two rollers, also referred to as a roller press or roll press instead of a roll mill. In the case of such known roller presses, see, for example, the brochure entitled "Rollenpressen" (Roller presses), No. 2-300d of KHD Humboldt Wedag AG dated September 1994 or, for example, WO 2005/070549 A1, one of the two rollers is designed in the form of a fixed roller which is supported via its bearing housing against end pieces of the machine frame, whilst the other roller, in the form of a loose roller, is supported via its bearing housing by hydraulic cylinders, by means of which the roller compaction force is applied.

During the operation of these types of roller presses, the surfaces of the rollers are exposed to a high level of wear and tear due to the high compacting pressures and pressing forces, especially when the loose roller, depending on the material supply to the roller nip, makes side deflecting movements, the central position of the roller nip and of the pressed material slug emerging downwards from said roller nip then altering due to the on the roller surface. Apart from the enormous dead weight provided by the heavily weighted rollers, a shock-like change in the roller nip width, for example caused by a foreign body going through the double rocker roller mill, is an additional strain on the rocker mounting pivot joints, which consequently have to be designed to be especially sturdy and weighty.

SUMMARY OF THE INVENTION

It is the object of the invention to create a roller press, particularly for comminuting a bed of material, said roller press having a conventional machine frame with bracket sliding tracks for the support of the roller bearing housings, the stress on the surface of the rollers being reduced and the service life of the rollers being increased on account of the machine design.

The roller press according to the invention does not have, as has been usual up to now, the one roller supported as a fixed roller via its bearing housing in a rigid manner on side parts of the machine frame, with the other roller as a loose roller supported via a hydraulic system so as to be resiliently deflectable, but according to the invention the two rollers are designed as loose rollers that are displaceable transversely relative to the roller nip, the bearing housings of which being supported on side parts of the machine frame by the hydraulic cylinders that apply the roller compaction pressure. This is to say, in the case of the roller press according to the invention, the loose roller side half is completely mirrored in practice at the machine center. With said machine design, the two loose rollers always deflect in a mirror-symmetrical manner relative to the original roller nip as the thickness of the pressed slug alters and, for example, if a foreign body passes through the roller nip. The deflecting movements and paths of the roller and the accelerations occurring at the same time and any possible roller inclinations are reduced by up to half per loose roller in comparison with the conventional roller press system.

Surprisingly it has been shown that by using the roller press according to the invention there is lower wear and tear on the roller surface, that is to say that the roller has a longer service life in roller press operation.

In order not to obstruct the deflecting movements of the two loose rollers in the case of the roller press according to the invention, the friction forces between the bearing housings and the sliding tracks of the machine bracket are to be as low as possible.

According to another feature of the invention, all hydraulic cylinders of the two loose rollers are impinged upon with pressure oil in such a manner that the two loose rollers are moved equally symmetrically towards the machine center in a mirror-image manner in relation to said machine center. To this end, the pressure oil chambers of all hydraulic cylinders can be connected to a nitrogen gas storage tank via an oil volume flow divider in such a manner that the two loose rollers are centered relative to the roller nip. However, it is also possible to measure the change in position of the two loose rollers and to adjust the pressure oil impingement of the individual hydraulic cylinders in view of the measured values of the loose roller positions.

In the case of the roller press according to the invention, the roller change can be simplified if at least one of the two side parts is pivotally mounted on the machine frame and is pivotable out to the side to change the roller. The hydraulic cylinders can then be secured advantageously to the respective side part of the machine frame that can be pivoted out in such a manner that the respective roller together with bearing housings is removable and installable via the hydraulic cylinder that is pivoted out via the side part.

BRIEF DESCRIPTION OF THE DRAWINGS

The invention and its additional features and advantages are described in more detail by way of the exemplary embodiments represented in the figures, in which.

BRIEF DESCRIPTION OF THE DRAWINGS

Figure 1:
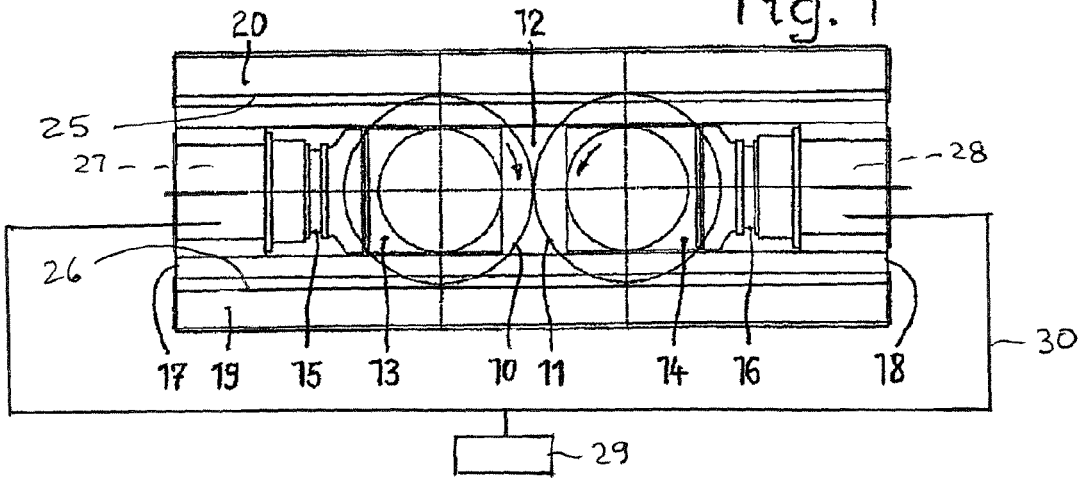
FIG. 1 is a first specific embodiment of the roller press according to the invention, particularly for the comminuting of a bed of granular material.

All three specific embodiments of the roller press according to the invention have a closed machine frame for absorbing the high roller compaction forces. In the case of all the exemplary embodiments, both rollers, that is both the left-hand roller 10 and the right-hand roller 11 are designed as loose rollers that are displaceable transversely relative to the roller nip 12, the bearing housings 13, 14 of said loose rollers being supported on side parts 17, 18 of the machine frame by hydraulic cylinders 15, 16 that apply the roller compaction pressure. The bottom sides and the top sides of all the bearing housings 13, 14 are mounted on the sliding tracks of the bottom and top brackets 19 and 20 of the machine frame. Other necessary machine components, such as the material delivery chute etc., have been omitted from the drawing.

According to another feature of the invention, all hydraulic cylinders 15, 16 of the two loose rollers are impinged upon with pressure oil in such a manner that the two loose rollers 10, 11 are moved equally symmetrically towards the machine center in a mirror-image manner in relation to said machine center. To this end, the pressure oil chambers 27, 28 of all hydraulic cylinders 15, 16 can be connected to a nitrogen gas storage tank 29 via an oil volume flow divider 30 in such a manner that the two loose rollers are centered relative to the roller nip. However, it is also possible to measure the change in position of the two loose rollers and to adjust the pressure oil impingement of the individual hydraulic cylinders in view of the measured values of the loose roller positions.

In the case of all three exemplary embodiments of the roller press according to the invention, the half sides of the respective loose roller are a complete symmetrical mirror image in the machine center, that is to say in relation to the roller gap 12 that remains in the central position, so that the two rollers 10, 11 are rollers that can be deflected out to the side in a symmetrical manner, the surfaces of the rollers thereby being exposed to less stress as mentioned above. This is particularly advantageous when the roller press according to the invention is used for comminuting a bed of abrasive granular material such as ore, cement clinker or the like, which causes a high level of wear and tear to the surfaces of the rollers.

Figure 2:
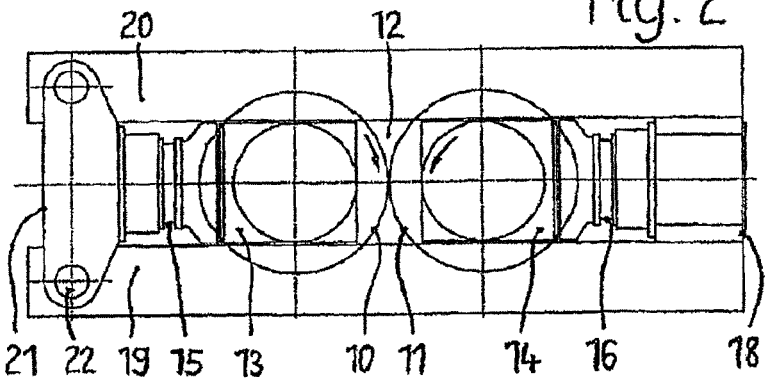
FIG. 2 is a second specific embodiment of the roller press according to the invention.
Figure 3:
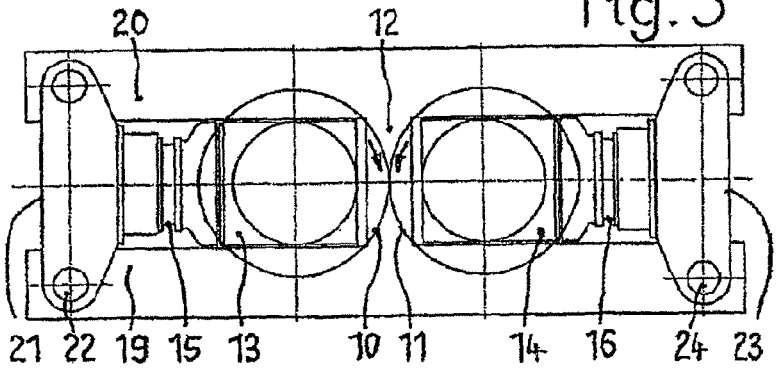
FIG. 3 is a third specific embodiment of the roller press according to the invention.

Nevertheless, should it become necessary to change the rollers, this can be simplified, for example, if at least one of the two side parts of the machine frame is pivotally mounted on the frame and is pivotable out to the side for changing the roller, such that the rollers can then be pulled out to the side via the pivoted-out side parts. Thus, according to FIG. 2, the side part located on the left-hand side of the machine can be pivoted out to the side as pivotal frame 21 via the pivoting joint 22. According to the exemplary embodiment in FIG. 3, in addition to this, the side part 23 located on the right-hand side of the machine can also be pivoted out to the side as a pivotal frame via the pivoting joint 24 so as to obtain a more convenient mounting procedure for each roller.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A roller press for the pressure treatment of granulated material, comprising:

two rollers rotatably mounted in bearing housings, driven in a counter-rotating manner and separated from each other by a roller nip, a machine frame for the roller press having brackets with sliding tracks formed therein, bottom sides and top sides of the bearing housings slidably mounted on the sliding tracks of the brackets of the machine frame such that the rollers mounted in the bearing housings are loose relative to one another and are movable transversely towards and away from one another relative to the roller nip and along the sliding tracks, hydraulic cylinders, each pressing on a roller bearing housing on the one hand and against the machine frame on the other hand, arranged to press one roller against the oppositely situated roller through the granulated material situated in the roller nip, the bearing housings of the rollers being supported on two side parts of the machine frame by the hydraulic cylinders that apply roll compaction pressure.

2. The roller press of claim 1, including a source of pressurized oil communicating with the hydraulic cylinders of the two loose rollers such that the two loose rollers are moved by the hydraulic cylinders equally symmetrically relative to a center of the nip in a mirror-image manner in relation to the center of the nip.

3. The roller press of claim 1, wherein at least one of the two side parts of the machine frame is pivotally mounted on the machine frame via a pivoting joint, and for changing one of the rollers, the at least one side part is pivotable out to the side as a pivoting frame.

4. The roller press of claim 3, wherein the hydraulic cylinders are secured in such a manner to the at least one side part of the machine frame that can be pivoted out that the respective roller, together with the bearing housings, is removable and installable via the hydraulic cylinder that has been pivoted out via the at least one side part.

5. A roller press for the pressure treatment of granulated material, comprising:

two rollers rotatably mounted in bearing housings, driven in a counter-rotating manner and separated from each other by a roller nip, a machine frame for the roller press having brackets with sliding tracks formed therein, bottom sides and top sides of the bearing housings slidably mounted on the sliding tracks of the brackets of the machine frame such that the rollers mounted in the bearing housings are loose relative to one another and are movable transversely towards and away from one another relative to the roller nip and along the sliding tracks, hydraulic cylinders, each pressing on a roller bearing housing on the one hand and against the machine frame on the other hand, arranged to press one roller against the oppositely situated roller through the granulated material situated in the roller nip, the bearing housings of the rollers being supported on two side parts of the machine frame by the hydraulic cylinders that apply roll compaction pressure, a source of pressurized oil communicating with the hydraulic cylinders of the two loose rollers such that the two loose rollers are moved by the hydraulic cylinders equally symmetrically relative to a center of the nip in a mirror-image manner in relation to the center of the nip, wherein the hydraulic cylinders have pressure oil chambers which are connected via an oil volume flow divider to a nitrogen gas storage tank such that the two loose rollers are provided with equal pressure of the pressurized oil and are thereby centered relative to the roller nip.

* * * * *